US007280749B2

(12) United States Patent
Loges et al.

(10) Patent No.: US 7,280,749 B2
(45) Date of Patent: Oct. 9, 2007

(54) FILAMENT FOR RADIATION SOURCE

(75) Inventors: Peter G. Loges, Natick, MA (US); James T. Daly, Mansfield, MA (US); V. Mark Villafuerte, Stoneham, MA (US); Christopher J. von Benken, Maynard, MA (US)

(73) Assignee: Ion Optics, Inc., Billerica, MA (US)

( * ) Notice: Subject to any disclaimer, the term of this patent is extended or adjusted under 35 U.S.C. 154(b) by 107 days.

(21) Appl. No.: 10/074,188

(22) Filed: Feb. 12, 2002

(65) Prior Publication Data

US 2002/0122663 A1 Sep. 5, 2002

Related U.S. Application Data

(60) Provisional application No. 60/268,179, filed on Feb. 12, 2001.

(51) Int. Cl.
*A45D 20/40* (2006.01)
*H05B 3/08* (2006.01)

(52) U.S. Cl. ..... 392/407; 219/541

(58) Field of Classification Search ..... 392/407, 392/408, 422, 426, 427, 429, 355, 435, 440, 392/428; 219/541, 553, 534, 455.12; 313/110, 313/222; 250/343; 216/48; 338/221; 362/296
See application file for complete search history.

(56) References Cited

U.S. PATENT DOCUMENTS

| | | | | |
|---|---|---|---|---|
| 1,514,628 | A * | 11/1924 | Pritzker | 219/455.12 |
| 1,572,395 | A * | 2/1926 | Kuhn et al. | 338/221 |
| 1,697,607 | A * | 1/1929 | Maxson | 392/428 |
| 2,467,479 | A * | 4/1949 | Huck | 392/429 |
| 3,077,531 | A * | 2/1963 | Wompey | 392/355 |
| 3,189,726 | A * | 6/1965 | Vary | 392/440 |
| 3,394,257 | A * | 7/1968 | Moldenhauer | 250/343 |
| 4,140,939 | A * | 2/1979 | Bonazoli et al. | 313/222 |
| 4,922,108 | A * | 5/1990 | Modlinski et al. | 250/504 R |
| 5,157,758 | A * | 10/1992 | Halberstadt et al. | 392/408 |
| 5,296,685 | A * | 3/1994 | Burstein et al. | 219/534 |
| 5,438,233 | A * | 8/1995 | Boland et al. | 313/110 |
| 5,838,016 | A | 11/1998 | Johnson | |
| 5,939,726 | A | 8/1999 | Wood | |
| 6,034,360 | A * | 3/2000 | Karlsson | 219/553 |
| 6,249,005 | B1 | 6/2001 | Johnson | |
| 6,262,431 | B1 | 7/2001 | Scherzer et al. | |
| 6,308,008 | B1 * | 10/2001 | Johansson et al. | 392/427 |
| 2002/0096492 | A1 * | 7/2002 | George et al. | 216/48 |

FOREIGN PATENT DOCUMENTS

| | | |
|---|---|---|
| WO | WO99/28729 | 6/1999 |

* cited by examiner

*Primary Examiner*—Daniel Robinson
(74) *Attorney, Agent, or Firm*—Mark G. Lappin; Foley & Lardner LLP

(57) ABSTRACT

A radiation source including a base, a curved reflector attached to the base, pins passing through the base and within the reflector, and a filament of high emissivity material helically wound about the pins and having opposing ends electrically connected to the pins so that upon passage of electrical energy through the filament, the filament becomes electrically heated and emits infrared radiation.

29 Claims, 2 Drawing Sheets

FILAMENT FOR RADIATION SOURCE

CROSS-REFERENCE TO RELATED APPLICATION

The present application claims priority to provisional U.S. patent application Ser. No. 60/268,179, filed on Feb. 12, 2001, which is assigned to the assignee of the present application and incorporated herein by reference.

FIELD OF THE INVENTION

The present invention generally relates to a radiation source which can be used in various calibration, reference and measurement instruments. In particular, the present invention relates to an infrared radiation source having a helical filament.

BACKGROUND OF THE INVENTION

The focus of the invention is a novel filament contained within a packaged radiation source device, configured to be a component in an instrumentation application. The specific application and embodiment described is an infrared radiation source for use in various calibration, reference and measurement instruments.

The tradeoffs and requirements of radiation sources for electromagnetic and optical radiation sources, and in particular the use of enclosed electrically-excited filaments, have been the subject of development for many years. As this development addressed more narrow and specific radiation requirements of controlled wavelength emission for accuracy and precision, power efficiency requirements for economy, and loss reduction and temperature control, the problems involved in design and manufacture of suitable radiation sources have become correspondingly more complex.

A particular application environment that has received a great deal of inquiry is the area of infrared radiation, which is efficiently useful and necessary in a variety of measurement and detection instrumentation. Many such applications are limited in power, space and cooling ability and require efficient illumination within a limited spectral band. The difficulty of achieving stability and control of temperature and emission wavelength in a thin, flat, electrically heated radiator has been known. Temperature stability has been a particular development objective of traditional infrared radiation sources for calibration and measurement applications, which rely on steady state heating of an object with relatively large thermal mass. This in turn requires a long turn-on and settling time for stable operation and produces a large amount of waste heat.

U.S. Pat. Nos. 5,838,016 and 6,249,005, both of which are assigned to the assignee of the present invention and are incorporated herein by reference, disclose and claim textured infrared radiation filaments and methods of manufacture. The surface treatment disclosed in said patents enhances the infrared emissions, and the resulting textured infrared radiation filaments compare favorably as an improvement over many previous radiation sources and can usefully replace such traditional reference emission sources.

International patent application number PCT/US98/25771 (WO 99/28729) which is also assigned to the assignee of the present invention and incorporated herein by reference, discloses and claims a radiation source fitted with a concentrating reflector. The reflector is shaped to direct emitted radiation along an axis of the radiation source and through a spectral filter. The reflector is parabolic, although other shapes, such as spherical, conical, and custom contours, can be used.

What is still desired is a radiation source that provides brighter illumination on-axis and a more uniform distribution of far-field illumination. Preferably, the improved radiation source will provide infrared radiation. In addition, the improved radiation source will also preferably include a filament providing infrared emissions enhanced by surface treatment.

SUMMARY OF THE INVENTION

A radiation source including a base, a curved reflector attached to the base, pins passing through the base and within the reflector, and a filament of high emissivity material helically wound about the pins and having opposing ends electrically connected to the pins so that upon passage of electrical energy through the filament, the filament becomes electrically heated and emits infrared radiation. The helically wound filament has been found to provide brighter illumination on-axis and a more uniform distribution of far-field illumination.

According to one aspect of the present invention, the wavelength spectrum of the filament is tuned to an infrared radiation range.

According to an additional aspect of the present invention, the filament has a textured surface with features therein that are approximately sized to a selected infrared wavelength spectrum. According to another aspect, the features are regularly distributed about the textured surface and extend outwardly from the surface. According to still another aspect, the features of the textured filament include peaks and valleys. According to a further aspect, the features are randomly distributed about the textured surface and extend outwardly from the surface. According to another aspect, the features are formed by ion beam bombardment.

According to another aspect of the present invention, the filament has a thickness of approximately five microns. According to an additional aspect, the filament comprises titanium foil.

According to one aspect of the present invention, the reflector is in the shape of a parabola. According to an additional aspect, the reflector is covered with a window. According to still another aspect, the reflector and the window form an enclosure for the helical filament which is hermetically sealed. According to a further aspect, an inert gas is contained within the enclosure, the inert gas comprising at least one of nitrogen, helium and mixtures thereof.

These aspects of the invention together with additional features and advantages thereof may best be understood by reference to the following detailed description of an exemplary embodiment taken in connection with the accompanying illustrated drawings.

BRIEF DESCRIPTION OF THE DRAWINGS

Like reference characters designate identical or corresponding components and units throughout the several views.

DETAILED DESCRIPTION OF AN EXEMPLARY EMBODIMENT

Figure 2:
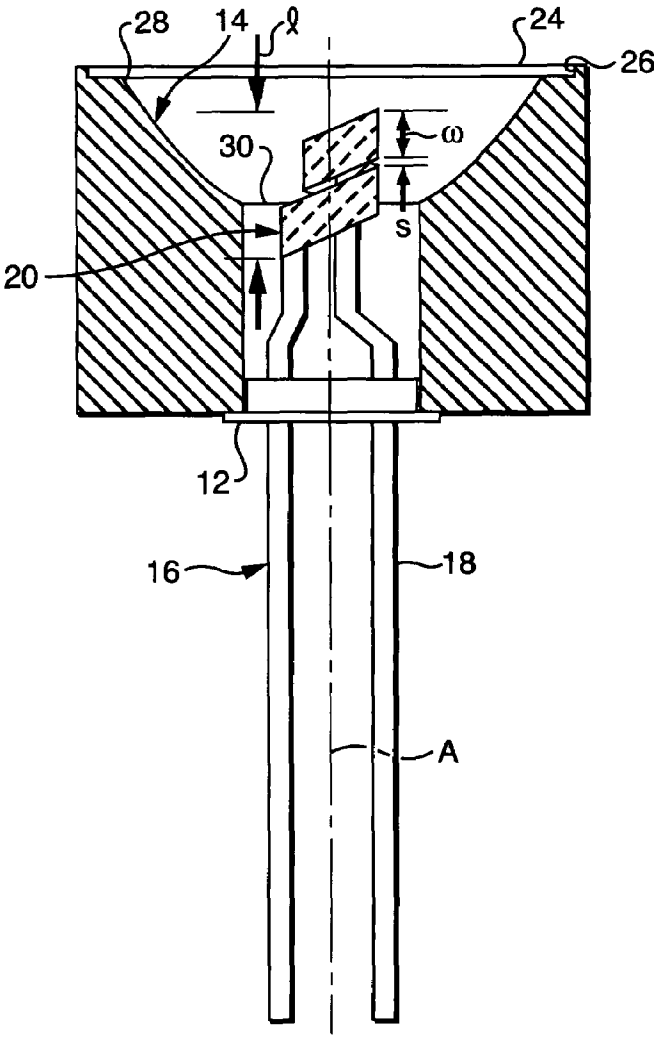
FIG. 2 is a side elevation view, partially cut-away, of the radiation emitter of FIG. 1.
Figure 1:
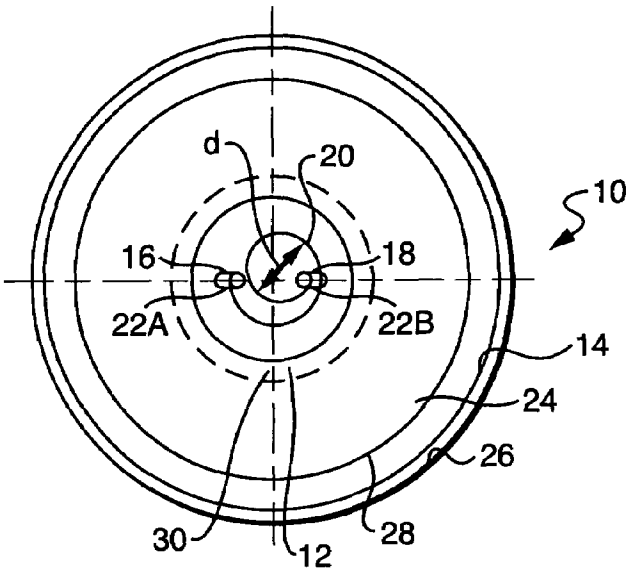
FIG. 1 is an end plan view of an exemplary embodiment of a radiation emitter constructed in accordance with the present invention.

Referring now to the drawings, FIGS. 1 and 2 show an exemplary embodiment of a radiation source 10 constructed in accordance with the present invention. The radiation source 10 includes a base 12, a curved reflector 14 attached to the base, pins 16, 18 passing through the base, within the reflector and along an axis "A" of the reflector, and a filament 20 of high emissivity material helically wound about the pins and having opposing ends 22*a*, 22*b* electrically connected to the pins 16, 18 so that upon passage of electrical energy through the filament 20, the filament becomes electrically heated and emits infrared radiation. The helically wound filament 20 has been found to provide brighter illumination along the axis "A" and a more uniform distribution of far-field illumination.

The wavelength spectrum of the helical filament 20 is tuned to an infrared radiation range. The filament 20 can be fabricated from a sheet or blank of suitable material, such as a thin metal foil. In infrared radiation applications, nickel-chromium foil is suited to tuning for the applicable frequency range. In an exemplary embodiment, the filament 20 has a thickness of approximately five microns. An outwardly facing surface (facing outwardly with respect to the axis "A") of the filament 20 is preferably textured in accordance with the infrared radiation filament and method of manufacture as disclosed and claimed in U.S. Pat. Nos. 5,838,016 and 6,249,005, both of which are assigned to the assignee of the present invention and both of which have been previously incorporated herein by reference. The filament 20 has a textured high emissivity outwardly facing surface with features therein that are approximately sized to a selected infrared wavelength spectrum. Although only the outwardly facing surface is textured and high emissivity, an inwardly facing surface (facing inwardly with respect to the axis "A") of the filament 20 can also be a textured high emissivity surface if desired.

A window 24 of a material suitably transparent or transmissive to the desired radiation spectrum of the instrument is closely fitted within a recess 26 around an outlet 28 of the reflector 14. As an instrument designed to operate in infrared frequencies is discussed here, the window 24 is formed of a sapphire which is not only transparent to infrared radiation but is suitably durable in demanding environments in which the radiation source 10 may be installed. The joints between the base 12 and the reflector 14 and between the reflector 14 and the window 24 are sealed in an air-tight manner, such as with epoxy, and the sealed reflector can be filled with an inert gas such as argon, to retard corrosion of the filament 20. Enclosing the filament 20 also prevents varying convection cooling.

The reflector 14 is shaped to direct emitted radiation along the axis "A" of the radiation source and through the window 24. In the embodiment shown, the reflector 14 is parabolic, although other shapes, such as elliptical, spherical, conical, and custom contours, can be used. International patent application number PCT/US98/25771 (WO 99/28729), which is also assigned to the assignee of the present invention and has previously been incorporated herein by reference, provides an example of a radiation source fitted with a parabolic concentrating reflector.

Preferably, the helical filament 20 is tightly wound, since it has been found that a more tightly coiled filament 20 provides better light collimation. In the particular embodiment of FIG. 1, for example, a smallest cross-sectional diameter "d" of the helical filament 20 is based upon a cross-sectional dimension of the reflector 14 taken at a focal point of the reflector 14. As an example, an embodiment of the radiation source 10 is provided with a helical filament 20 having a smallest cross-sectional diameter "d" equal to about 0.067 inches, and a cross-sectional dimension of the reflector 14 taken at a focal point of the reflector 14 is equal to about 0.28 inches.

In addition, as shown in FIG. 2, a space "s" between adjacent coils of the helically wound filament 20 is kept relatively small in comparison to a width "w" of the filament 20 and an overall length "l" of the coiled filament along the "A" axis, to provide a more solid output of light against the reflector 14. The filament 20 can be configured such that the outwardly facing surface is parallel to the "A" axis, as shown. The wound filament 20 shown in FIG. 2 includes two coils, one centered on the "A" axis and the second being offset from the "A" axis. As an example, an embodiment of the radiation source 10 is provided with a helical filament 20 having a space "s" equal to about 0.010 inches, a width "w" equal to about 0.048 inches, and an overall length "l" along the "A" axis equal to about 0.106 inches.

In the embodiment of FIGS. 1 and 2, the diameter of the helically wound filament 20 decreases monotonically along the axis "A" towards the window 20. However, the helically wound filament 20 can alternatively be provided with a constant diameter along the axis "A"

Figure 3:
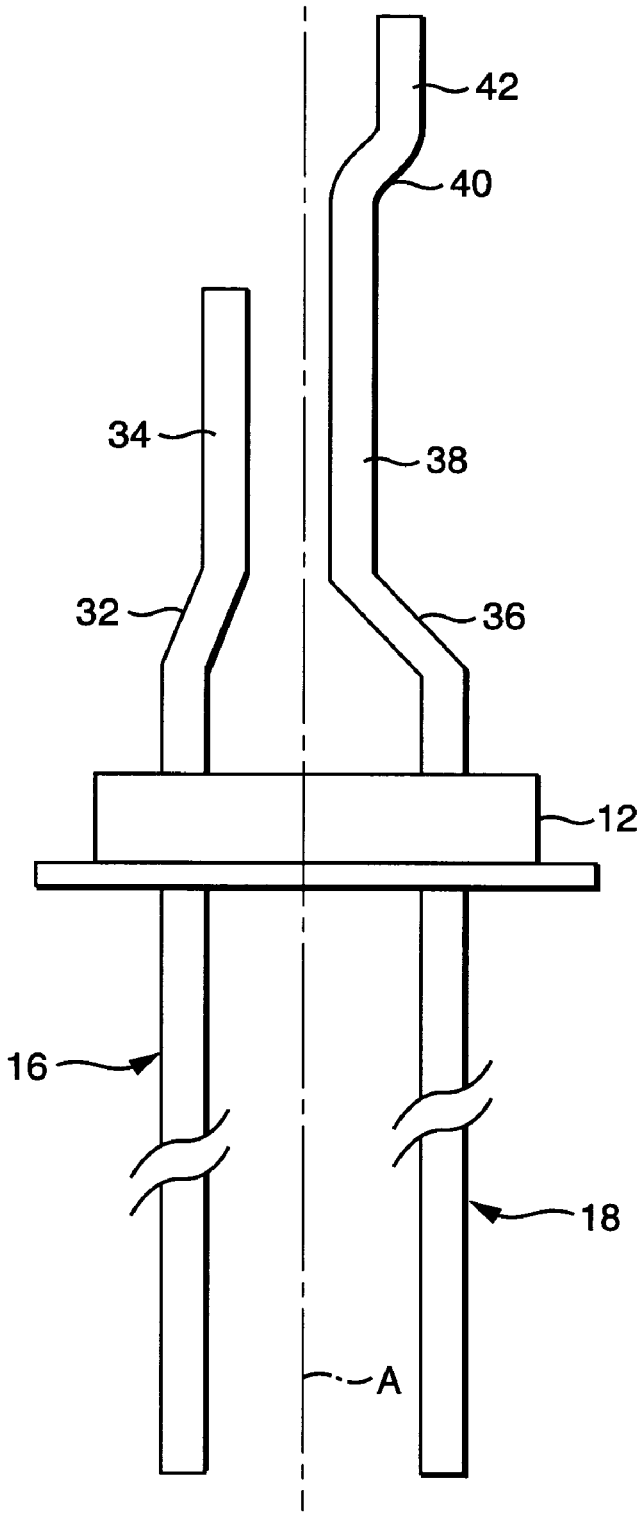
FIG. 3 is a side elevation view of support structure of the radiation emitter of FIG. 1.

Referring also to FIG. 3, the pins include a first pin 16 and a second pin 18, and the pins are shaped in such a manner as to make the positioning of the helical filament 20 with respect to the reflector 14 repeatable and accurate during mass production of the radiation source 10. In addition, the pins 16, 18 are preferably made of nickel-plated kovar.

In particular, the first pin 16 includes a first portion 32 extending at an angle with respect to the axis "A" towards the second pin 18, and a second portion 34 extending from the first portion 32 parallel with the axis "A". The second pin 18 includes a first portion 36 extending at an angle with respect to the axis "A" towards the first pin 16 and a second portion 38 extending from the first portion 36 of the second pin parallel with the axis "A". The second pin 18 further includes a third portion 40 extending from the second portion 38 of the second pin at an angle with respect to the axis "A" and away from the first pin 16, and a fourth portion 42 extending from the third portion 40 of the second pin parallel with the axis "A". The first end 22*a* of the helically wound filament 20 is attached to the second portion 34 of the first pin 16 and the second end 22*b* of the helically wound filament 20 is attached to the fourth portion 42 of the second pin 18. Preferably, the pins 16, 18 and the helical filament 20 are adapted such that the filament 20 extends through an inlet 30 of the curved reflector 14, such that the reflector is entirely illuminated by the energized filament 20 to provide an intense and even light distribution.

It should be understood that the embodiment described herein is merely exemplary and that a person skilled in the art may make variations and modifications to the embodiment described without departing from the spirit and scope of the present invention. All such equivalent variations and modifications are intended to be included within the scope of this invention as defined by the appended claims.

What is claimed is:

1. A radiation source comprising:

a base;

a curved reflector extending along an axis and attached to the base;

at least two pins passing through the base, within the reflector, and along the axis of the reflector; and a filament helically wound about the pins such that the pins are located between the filament and the axis of the reflector, the filament having a high emissivity outwardly facing surface and a low emissivity inwardly facing surface, wherein the outwardly facing surface is parallel to the axis, and opposing ends electrically connected to a respective one of the pins so that upon passage of electrical energy through the filament, the filament becomes electrically heated and emits infrared radiation, wherein the helically wound filament has a diameter that monotonically decreases along the axis and away from the base and a width of the filament is greater than a space between adjacent coils of the helically wound filament, and wherein the helically wound filament forms at least two coils and at least one of the coils is offset from the axis.

2. The radiation source of claim 1 wherein the reflector is parabolic.

3. The radiation source of claim 1 wherein the reflector is elliptical.

4. The radiation source of claim 1 wherein the reflector is covered with a window.

5. The radiation source of claim 4 wherein the window includes at least one of sapphire, calcium fluoride, zinc selenide, silicon or germanium.

6. The radiation source of claim 4 wherein the base, the reflector and the window form an enclosure for the helical filament which is hermetically sealed.

7. The radiation source of claim 6 wherein an inert gas is contained within the enclosure.

8. The radiation source of claim 1 wherein at least one of the ends of the helical filament is wrapped around one of the pins to provide a mechanism for strain relief.

9. The radiation source of claim 1 wherein the reflector comprises a non ferrous metal.

10. The radiation source of claim 1 wherein the reflector is coated or plated with at least one of aluminum, gold and silver.

11. The radiation source of claim 1 wherein the outwardly facing surface of the filament is textured with features that are approximately sized to a selected infrared wavelength spectrum.

12. The radiation source of claim 11 wherein the features are regularly distributed about the textured surface and extend outwardly from the surface.

13. The radiation source of claim 11, wherein the features are sized to between about two and ten microns.

14. The radiation source of claim 11, wherein the features are substantially uniform in size such that the emissions have a cut-off wavelength greater than the size of the features.

15. The radiation source of claim 14, wherein the cut-off wavelength is approximately $2\pi$ times the size of the features.

16. The radiation source of claim 11, wherein the features comprise peaks and valleys.

17. The radiation source of claim 11 wherein the features are randomly distributed about the textured surface and extend outwardly from the surface.

18. The radiation source of claim 11, wherein the features are formed by ion beam bombardment.

19. The radiation source according to claim 1, wherein the filament has a thickness of approximately five microns.

20. The radiation source of claim 1 wherein the wavelength spectrum of the filament is tuned to an infrared radiation range.

21. The radiation source of claim 1 wherein the filament comprises nickel-chromium foil.

22. The radiation source of claim 1 wherein the helically wound filament extends through an inlet of the curved reflector.

23. The radiation source of claim 1 wherein the pins include a first pin and a second pin, and the pins each include a portion extending at an angle with respect to the axis of the reflector.

24. The radiation source of claim 23, wherein:

the first pin includes a first portion extending at an angle with respect to the axis towards the second pin and a second portion extending from the first portion parallel with the axis; and the second pin includes a first portion extending at an angle with respect to the axis towards the first pin and a second portion extending from the first portion of the second pin parallel with the axis.

25. The radiation source of claim 24 wherein the second pin further includes a third portion extending from the second portion of the second pin at an angle with respect to the axis and away from the first pin, and a fourth portion extending from the third portion of the second pin parallel with the axis, and wherein the a first end of the helically wound filament is attached to the second portion of the first pin and a second end of the helically wound filament is attached to the fourth portion of the second pin.

26. The radiation source of claim 1 wherein the pins are made of nickel-plated kovar.

27. The radiation source of claim 1, wherein the helically wound filament forms two coils.

28. The radiation source of claim 1, wherein the coil furthest from the base is offset from the axis.

29. The radiation source of claim 28, wherein the helically wound filament forms two coils and the coil closest to the base is aligned with the axis.

* * * * *